US009989897B2

(12) United States Patent
Okamoto et al.

(10) Patent No.: US 9,989,897 B2
(45) Date of Patent: Jun. 5, 2018

(54) FIXING DEVICE AND IMAGE FORMING APPARATUS INCLUDING FIXING DEVICE WITH LUBRICANT MOVEMENT RESTRICTORS

(71) Applicants: Jun Okamoto, Tokyo (JP); Hiroyuki Shimada, Tokyo (JP); Yoshio Hattori, Kanagawa (JP); Haruyuki Honda, Kanagawa (JP)

(72) Inventors: Jun Okamoto, Tokyo (JP); Hiroyuki Shimada, Tokyo (JP); Yoshio Hattori, Kanagawa (JP); Haruyuki Honda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/379,354

(22) Filed: Dec. 14, 2016

(65) Prior Publication Data

US 2017/0176899 A1 Jun. 22, 2017

(30) Foreign Application Priority Data

Dec. 17, 2015 (JP) ..... 2015246265
Dec. 17, 2015 (JP) ..... 2015246268

(51) Int. Cl.
*G03G 15/20* (2006.01)

(52) U.S. Cl.
CPC ..... *G03G 15/2025* (2013.01); *G03G 15/2075* (2013.01); *G03G 2215/2035* (2013.01)

(58) Field of Classification Search
CPC ..... G03G 15/2025; G03G 15/2053; G03G 15/2075; G03G 2215/2009; G03G 2215/2016; G03G 2215/2035
(Continued)

(56) References Cited

U.S. PATENT DOCUMENTS 8,135,323 B2 * 3/2012 Suzuki ..... G03G 15/2064 399/329
8,175,510 B2 * 5/2012 Nagase ..... G03G 15/206 219/216
(Continued)

FOREIGN PATENT DOCUMENTS

JP 2004-286922 10/2004
JP 2005-300983 10/2005
(Continued)

*Primary Examiner* — Robert Beatty

(74) *Attorney, Agent, or Firm* — Duft Bornsen & Fettig LLP

(57) ABSTRACT

A fixing device includes a rotatable endless fixing belt, a pressure rotator, a nip formation pad, a lubricant impregnated member, and restrictors. The pressure rotator contacts an outer circumferential face of the fixing belt. The nip formation pad is disposed at an inner circumferential side of the fixing belt, to contact the pressure rotator via the fixing belt to form a nip. The lubricant impregnated member is disposed on the nip formation pad to contact an inner circumferential face of the fixing belt. The lubricant impregnated member is impregnated with lubricant. The restrictors, each disposed at an inner side than each end in a width direction of the fixing belt, regulate movement of the lubricant adhering to the fixing belt, toward each end of the fixing belt in the width direction. The restrictors have a lower absorbability of the lubricant than an absorbability of the lubricant impregnated member.

12 Claims, 7 Drawing Sheets

(58) Field of Classification Search
USPC ..... 399/325, 329; 219/216
See application file for complete search history.

(56) References Cited

U.S. PATENT DOCUMENTS

| | | | |
|---|---|---|---|
| 2007/0292175 | A1 | 12/2007 | Shinshi |
| 2012/0121303 | A1 | 5/2012 | Takagi et al. |
| 2013/0164059 | A1 | 6/2013 | Takagi et al. |
| 2014/0119787 | A1 | 5/2014 | Hasegawa |
| 2014/0286684 | A1 | 9/2014 | Takagi et al. |
| 2015/0055993 | A1 | 2/2015 | Shoji |
| 2015/0055994 | A1 | 2/2015 | Shoji et al. |
| 2015/0110531 | A1 | 4/2015 | Takagi et al. |
| 2015/0261148 | A1 | 9/2015 | Yamaguchi et al. |
| 2016/0154350 | A1 | 6/2016 | Saito et al. |
| 2016/0161890 | A1 | 6/2016 | Shoji et al. |
| 2016/0274509 | A1 | 9/2016 | Honda et al. |
| 2016/0274513 | A1 | 9/2016 | Yamaguchi et al. |
| 2016/0274523 | A1 | 9/2016 | Mimbu et al. |

FOREIGN PATENT DOCUMENTS

| | | | | |
|---|---|---|---|---|
| JP | 2006038990 | A | * | 2/2006 |
| JP | 2006072218 | A | * | 3/2006 |
| JP | 2007-334205 | | | 12/2007 |
| JP | 2008107465 | A | * | 5/2008 |
| JP | 2009-109697 | | | 5/2009 |
| JP | 2009-134074 | | | 6/2009 |
| JP | 2010-079309 | | | 4/2010 |
| JP | 2010-204587 | | | 9/2010 |
| JP | 2013083677 | A | * | 5/2013 |
| JP | 2014071212 | A | * | 4/2014 |
| JP | 2014-089234 | | | 5/2014 |
| JP | 2014-174358 | | | 9/2014 |
| JP | 2014-178405 | | | 9/2014 |
| JP | 2014-178520 | | | 9/2014 |
| JP | 2015069094 | A | * | 4/2015 |

* cited by examiner

FIXING DEVICE AND IMAGE FORMING APPARATUS INCLUDING FIXING DEVICE WITH LUBRICANT MOVEMENT RESTRICTORS

CROSS-REFERENCE TO RELATED APPLICATIONS

This patent application is based on and claims priority pursuant to 35 U.S.C. § 119(a) to Japanese Patent Application Nos. 2015-246265, filed on Dec. 17, 2015, and 2015-246268, filed on Dec. 17, 2015, in the Japan Patent Office, the entire disclosure of each of which is hereby incorporated by reference herein.

BACKGROUND

Technical Field

Embodiments of the present disclosure relate to a fixing device and an image forming apparatus including the fixing device.

Related Art

An image forming apparatus is known that includes a fixing device to form a nip by pressing a nip formation pad against a pressure rotator in a state of nipping a fixing belt, as a fixing device with a short warm-up time and less power consumption.

For example, in a fixing device, a slide sheet, which serves as a lubricant impregnated member impregnated with lubricant such as silicone oil, is attached to a contact portion of the above-described nip formation pad and the fixing belt. The lubricant, with which the above-described slide sheet attached to the nip formation pad is impregnated, adheres to the inner circumferential face of the fixing belt, so that the lubricant interposes between the slide sheet and the fixing belt. With such a configuration, the frictional force generated between the slide sheet and the fixing belt can be reduced by the lubricating effect of the lubricant, thus allowing smooth rotation of the fixing belt.

SUMMARY

In one aspect of the present disclosure, there is provided a fixing device that includes a rotatable endless fixing belt, a pressure rotator, a nip formation pad, a lubricant impregnated member, and a plurality of restrictors. The pressure rotator contacts an outer circumferential face of the fixing belt. The nip formation pad is disposed at an inner circumferential side of the fixing belt, to contact the pressure rotator via the fixing belt to form a nip. The lubricant impregnated member is disposed on the nip formation pad to contact an inner circumferential face of the fixing belt. The lubricant impregnated member is impregnated with lubricant. The plurality of restrictors, each disposed at an inner side than each end of the fixing belt in a width direction of the fixing belt, regulates movement of the lubricant adhering to the fixing belt, toward each end of the fixing belt in the width direction of the fixing belt. The plurality of restrictors has a lower absorbability of the lubricant than an absorbability of the lubricant impregnated member.

In another aspect of the present disclosure, there is provided an image forming apparatus that includes an image bearer, a toner image forming unit, a transfer unit, and the fixing device. The toner image forming unit forms a toner image on the image bearer. The transfer unit transfers the toner image from a surface of the image bearer onto a recording material. The fixing device fixes the toner image transferred on the recording material, onto the recording material.

In still another aspect of the present disclosure, there is provided a fixing device that includes a rotatable endless fixing belt, a pressure rotator, a nip formation pad, a lubricant impregnated member, a plurality of guide members, and a plurality of restrictors. The pressure rotator contacts an outer circumferential face of the fixing belt. The nip formation pad is disposed at an inner circumferential side of the fixing belt, to contact the pressure rotator via the fixing belt to form a nip. The lubricant impregnated member is disposed on the nip formation pad to contact an inner circumferential face of the fixing belt. The lubricant is impregnated member impregnated with lubricant. The plurality of guide members contacts the inner circumferential face of the fixing belt at both ends of the fixing belt in a width direction of the fixing belt, to guide rotation of the fixing belt. The plurality of restrictors is disposed at an inner side than the plurality of guide members in the width direction of the fixing belt, to restrict movement of the lubricant adhering to the inner circumferential face of the fixing belt, toward an outer side in the width direction of the fixing belt.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
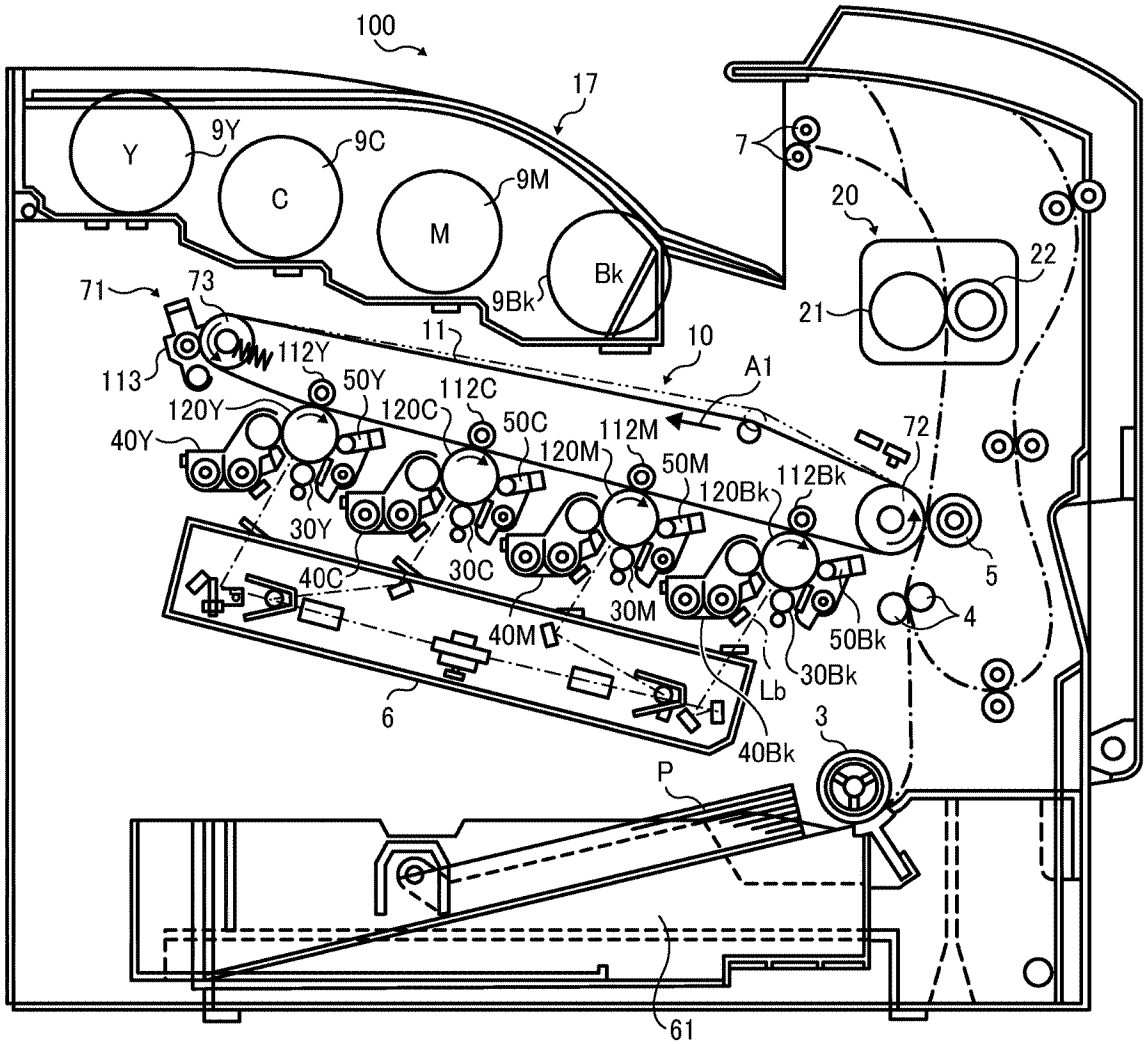
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Embodiments of the present disclosure will be described below referring to the drawings. In addition, in the drawings for describing the embodiments of the present disclosure, components such as members and components having the same functions or the shapes are assigned the same signs wherever distinguishable. The descriptions thereof will be thereby omitted after once described.

FIG. 1 is a schematic view of a configuration of an image forming apparatus 100 according to the present embodiment. The image forming apparatus 100 illustrated in FIG. 1 is a tandem system color laser printer. In addition, an imaging station is disposed at a center part of an apparatus body of the image forming apparatus 100. The imaging station includes image forming units (four image forming units in the example illustrated in FIG. 1) for forming an image with a plurality of colors.

The plurality of image forming units is arranged side by side along a stretched direction of an intermediate transfer belt 11 serving as an endless belt type intermediate transfer member. In addition, the image forming units have similar configurations except that the image forming units contain developers of different colors, i.e., yellow (Y), magenta (M), cyan (C), and black (Bk) corresponding to color separation components of a color image.

In FIG. 1, photoconductor drums 120Y, 120C, 120M, and 120Bk serving as a plurality of image bearers respectively corresponding to colors separated into the respective colors of yellow, cyan, magenta, and black are arranged side by side in the image forming apparatus 100.

A primary transfer step of toner images being visible images of the respective colors that have been formed on the respective photoconductor drums 120Y, 120C, 120M, and 120Bk is executed on the intermediate transfer belt 11 that is movable in a direction indicated by arrow A1, while opposing the photoconductor drums 120Y, 120C, 120M, and 120Bk. As a result, the toner images of the respective colors are transferred onto the intermediate transfer belt 11 and superimposed one on another. After that, a secondary transfer step of the toner images of the respective colors that have been transferred onto the intermediate transfer belt 11 and superimposed one on another is executed on a sheet of paper P serving as a recording material. The toner images are thereby collectively transferred onto the sheet P.

Various types of devices for performing image forming processing in accordance with the rotation of the photoconductor drum 120 are disposed around each of the photoconductor drums 120Y, 120C, 120M, and 120Bk.

The photoconductor drum 120Bk that performs black image formation will now be described. A charging device 30Bk, a developing device 40Bk, a primary transfer roller 112Bk serving as a primary transfer device, and a cleaning device 50Bk that perform image forming processing along the rotation direction of the photoconductor drum 120Bk are disposed around the photoconductor drum 120Bk. An optical writing device 6 serving as an exposure unit that exposes the surface of the photoconductor drum 120Bk is used for writing an electrostatic latent image onto the charged photoconductor drum 120Bk.

The optical writing device 6 includes a semiconductor laser serving as a light source, a coupling lens, an fθ lens, a toroidal lens, a folding mirror, a rotary polygon mirror (polygon mirror) serving as a light deflector, and the like. The optical writing device 6 is formed to emit, based on image data, writing light (laser beam) Lb onto the respective surfaces of the photoconductor drums 120Y, 120C, 120M, and 120Bk, and to form electrostatic latent images on the photoconductor drums 120Y, 120C, 120M, and 120Bk.

The toner images are transferred onto the intermediate transfer belt 11 and superimposed one on another in such a manner that the visible images (toner images) formed on the photoconductor drums 120Y, 120C, 120M, and 120Bk are transferred onto the same position of the intermediate transfer belt 11 and superimposed one on another, when the intermediate transfer belt 11 moves in the direction indicated by arrow A1 in FIG. 1.

More specifically, a primary transfer bias is applied to each of a plurality of primary transfer rollers 112Y, 112C, 112M, and 112Bk disposed opposing the respective photoconductor drums 120Y, 120C, 120M, and 120Bk via the intermediate transfer belt 11. By the primary transfer rollers 112Y, 112C, 112M, and 112Bk to which the primary transfer biases have been applied, the toner images formed on the respective photoconductor drums 120Y, 120C, 120M, and 120Bk are transferred and superimposed one on another at different timings in the rotation direction A1 of the intermediate transfer belt 11.

The plurality of primary transfer rollers 112Y, 112C, 112M, and 112Bk forms primary transfer nips by nipping the intermediate transfer belt 11 between the primary transfer rollers 112Y, 112C, 112M, and 112Bk and the photoconductor drums 120Y, 120C, 120M, and 120Bk, respectively. In addition, a power source is connected to each of the primary transfer rollers 112Y, 112C, 112M, and 112Bk. In addition, the primary transfer bias including at least either one of predetermined direct current voltage (DC) and alternating current voltage (AC) is applied by the power source to each of the primary transfer rollers 112Y, 112C, 112M, and 112Bk.

The photoconductor drums 120Y, 120C, 120M, and 120Bk are arranged in this order from an upstream side in the direction indicated by arrow A1 in FIG. 1. The photoconductor drums 120Y, 120C, 120M, and 120Bk are disposed in the plurality of image forming units that respectively form the images of yellow, cyan, magenta, and black.

In addition, in addition to the plurality of image forming units, the image forming apparatus 100 includes a transfer belt unit 10, a secondary transfer roller 5, a transfer-belt cleaning device 113, and the optical writing device 6.

In addition to the intermediate transfer belt 11 and the plurality of primary transfer rollers 112Y, 112C, 112M, and 112Bk, the transfer belt unit 10 includes a plurality of belt supports such as a drive roller 72 and a driven roller 73, around which the intermediate transfer belt 11 is stretched. By the drive roller 72 being driven to rotate, the intermediate transfer belt 11 rotates in the direction indicated by arrow A1 in FIG. 1.

The drive roller 72 also functions as a secondary-transfer backup roller opposing the secondary transfer roller 5 via the intermediate transfer belt 11. The driven roller 73 also functions as a cleaning backup roller opposing the transfer-belt cleaning device 113 via the intermediate transfer belt 11. In addition, the driven roller 73 also functions as a tension biasing member for the intermediate transfer belt 11. Thus, the driven roller 73 is disposed with a biasing member using a spring or the like. A transfer device 71 includes the transfer belt unit 10, the primary transfer rollers 112Y, 112C, 112M, and 112Bk, the secondary transfer roller 5, and the transfer-belt cleaning device 113.

The secondary transfer roller 5 is disposed opposing the intermediate transfer belt 11, and rotates in accordance with the intermediate transfer belt 11. In addition, the secondary transfer roller 5 forms a secondary transfer nip by nipping the intermediate transfer belt 11 between itself and the drive roller 72 also functioning as a secondary-transfer backup roller.

In addition, similarly to the primary transfer rollers 112Y, 112C, 112M, and 112Bk, a power source is also connected to the secondary transfer roller 5. A secondary transfer bias including at least either one of predetermined direct current voltage (DC) and alternating current voltage (AC) is applied to the secondary transfer roller 5.

The transfer-belt cleaning device 113 is disposed opposing the driven roller 73 via the intermediate transfer belt 11, and cleans the surface of the intermediate transfer belt 11. In the example illustrated in FIG. 1, the transfer-belt cleaning device 113 includes a cleaning brush and a cleaning blade that are disposed to contact the intermediate transfer belt 11. In addition, a waste-toner transfer hose extending from the transfer-belt cleaning device 113 is connected to an entry portion of a waste-toner container.

Furthermore, the image forming apparatus 100 includes a sheet feeding device 61 in which the sheets P serving as a recording material are stacked and stored, paired registration rollers 4 serving as a recording material feeder, and a sheet leading end sensor serving as a recording-material leading-end sensor.

The sheet feeding device 61 is disposed at the lower part of the body of the image forming apparatus 100, and includes a sheet feed roller 3 serving as a recording-material feeder to contact the top face of the uppermost sheet P. In addition, the sheet feed roller 3 is formed to feed the uppermost sheet P toward the paired registration rollers 4 by being driven to rotate in a counterclockwise direction in FIG. 1.

In addition, a sheet conveyance path for ejecting the sheet P from the sheet feeding device 61 to the outside of the apparatus through the secondary transfer nip is disposed within the apparatus body. The paired registration rollers 4 that convey the sheet P by feeding out the sheet P toward the secondary transfer nip are disposed on a sheet conveyance direction upstream side of the position of the secondary transfer roller 5 of the sheet conveyance path.

The paired registration rollers 4 feeds out the sheet P that has been conveyed from the sheet feeding device 61, toward the secondary transfer nip between the secondary transfer roller 5 and the intermediate transfer belt 11, at a predetermined timing synchronized with a timing of toner image formation performed by the imaging station including the above-described plurality of image forming units. In addition, the sheet leading end sensor detects that the leading end of the sheet P has reached the paired registration rollers 4.

Here, examples of the sheet P serving as a recording material include a cardboard, a postcard, an envelope, thin paper, coated paper (e.g., art paper), tracing paper, an overhead projector (OHP) sheet, a recording sheet, and the like, in addition to plain paper. In addition, in addition to the sheet feeding device 61, a bypass sheet feeder may be included so that the sheet P can be manually supplied.

In addition, the image forming apparatus 100 includes a fixing device 20 serving as a fixing unit for fixing the toner image onto the sheet P on which the toner image has been transferred, paired sheet ejection rollers 7 serving as a recording-material ejector, and a sheet ejection tray 17 serving as a recording-material stacker. The paired sheet ejection rollers 7 eject the sheet P of which the fixing has been performed, to the outside of the body of the image forming apparatus 100. The sheet ejection tray 17 is disposed at the upper part of the body of the image forming apparatus 100. The sheets P ejected by the paired sheet ejection rollers 7 to the outside of the body of the image forming apparatus 100 are stacked and stored on the sheet ejection tray 17.

In addition, the image forming apparatus 100 includes toner bottles 9Y, 9C, 9M, and 9Bk serving as a plurality of toner containers. The plurality of toner bottles 9Y, 9C, 9M, and 9Bk is replenished with toners of the respective colors of yellow, cyan, magenta, and black, and is detachably attached to a plurality of bottle containers disposed at an upper part of the apparatus body and below the sheet ejection tray 17.

In addition, replenishment paths are disposed between the toner bottles 9Y, 9C, 9M, and 9Bk and respective developing devices 40Y, 40C, 40M, and 40Bk. In addition, via the replenishment paths, the developing devices 40Y, 40C, 40M, and 40Bk are replenished with toners from the respective toner bottles 9Y, 9C, 9M, and 9Bk.

The transfer-belt cleaning device 113 disposed in the transfer device 71 includes the cleaning brush and the cleaning blade that are disposed to contact the intermediate transfer belt 11.

A foreign substance such as residual toner on the intermediate transfer belt 11 is scraped off and removed by the cleaning brush and the cleaning blade, so that the intermediate transfer belt 11 is cleaned. In addition, the transfer-belt cleaning device 113 includes a discharger for discharging and discarding the residual toner removed from the intermediate transfer belt 11.

Next, a basic operation of the image forming apparatus 100 will be described. If an image forming operation is started in the image forming apparatus 100, the photoconductor drums 120Y, 120C, 120M, and 120Bk in the respective image forming units are driven by a driving device to rotate in a clockwise direction in FIG. 1. Then, the surfaces of the photoconductor drums 120Y, 120C, 120M, and 120Bk are uniformly charged by the respective charging devices 30Y, 30C, 30M, and 30Bk to a predetermined polarity.

Laser beams are emitted from the optical writing device 6 onto the surfaces of the charged photoconductor drums 120Y, 120C, 120M, and 120Bk, so that electrostatic latent images are formed on the surfaces of the photoconductor drums 120Y, 120C, 120M, and 120Bk. At this time, image information exposed to each of the photoconductor drums 120Y, 120C, 120M, and 120Bk is monochromatic image information obtained by separating a desired full color image into color information pieces of yellow, magenta, cyan, and black.

By supplying the toners by the developing devices 40Y, 40C, 40M, and 40Bk to the electrostatic latent images formed on the respective photoconductor drums 120Y, 120C, 120M, and 120Bk in this manner, the electrostatic latent images are actualized as images (visualized as visible images) as toner images.

In addition, when the image forming operation is started, the drive roller 72 is driven to rotate in the counterclockwise direction in FIG. 1, to rotate the intermediate transfer belt 11 in the direction indicated by arrow A1 in FIG. 1. Then, constant voltage or constant-current-controlled voltage having a polarity opposite to a charging polarity of toner is applied to each of the primary transfer rollers 112Y, 112C, 112M, and 112Bk. As a result, predetermined transfer electric fields are formed at the primary transfer nips between the primary transfer rollers 112Y, 112C, 112M, and 112Bk and the respective photoconductor drums 120Y, 120C, 120M, and 120Bk.

After that, by the transfer electric fields formed at the primary transfer nips, the toner images on the photoconductor drums 120Y, 120C, 120M, and 120Bk are sequentially transferred onto the intermediate transfer belt 11 and superimposed one on another, so that a full-color toner image is borne on the surface of the intermediate transfer belt 11.

In addition, the toners on the photoconductor drums 120Y, 120C, 120M, and 120Bk that have been untransferred onto the intermediate transfer belt 11 are removed by cleaning devices 50Y, 50C, 50M, and 50Bk. After that, the surfaces of the photoconductor drums 120Y, 120C, 120M, and 120Bk are electrically discharged by a discharging device, so that surface potentials are initialized.

At the lower part of the image forming apparatus 100, the sheet feed roller 3 starts rotational driving, and the sheet P is fed out from the sheet feeding device 61 to a conveyance path. The sheet P fed out to the conveyance path is fed to the secondary transfer nip between the drive roller 72 also functioning as a secondary-transfer backup roller and the secondary transfer roller 5, at a timing adjusted by the paired registration rollers 4. At this time, transfer voltage having a polarity opposite to a toner charging polarity of the toner images on the intermediate transfer belt 11 is applied to the secondary transfer roller 5, and a predetermined transfer electric field is formed at the secondary transfer nip.

After that, when the toner images on the intermediate transfer belt 11 reach the secondary transfer nip in accordance with the rotation of the intermediate transfer belt 11, the toner images on the intermediate transfer belt 11 are collectively transferred onto the sheet P by the transfer electric field formed at the secondary transfer nip.

In addition, residual toner on the intermediate transfer belt 11 that has been untransferred onto the sheet P at this time is removed by the transfer-belt cleaning device 113, and the removed toner is conveyed to and collected into the waste-toner container.

After that, the sheet P is conveyed to the fixing device 20, and the toner image on the sheet P is fixed by the fixing device 20 onto the sheet P. Then, the sheet P is ejected by the paired sheet ejection rollers 7 to the outside of the apparatus, and stocked on the sheet ejection tray 17.

In addition, the image forming operation performed when a full color image is formed on the sheet P has been described above. Alternatively, a monochromatic image can be formed by using any one of the four image forming units, or a two-color or three-color image can be formed by using two or three of image forming units.

In addition, the image forming apparatus 100 illustrated in FIG. 1 is a color printer using a tandem system, in which image forming units for forming an image with a plurality of colors are arranged side by side along the stretched direction of the belt. However, the system of the image forming apparatus is not limited to this system. In addition, in addition to printers, copiers, facsimile machines, and the like can be targeted.

Here, as everyone knows, an electrophotographic image forming apparatus outputs a copy image through the following steps. More specifically, an electrostatic latent image formed on a photoconductor serving as a latent image bearer is processed using toner, to become a visible image, and the toner image is transferred and then fixed onto a recording material such as a sheet. A copy image is thereby output.

Examples of a fixing system used in the image forming apparatus include a heating-roller fixing system, a belt fixing system, a film fixing system, an electromagnetic induction heating system, and the like.

In the heat-fixing-roller fixing system, a fixing roller and a pressure roller are used. The fixing roller and the pressure roller contacts each other while opposing each other across a conveyance path of a sheet. In this system, by the functions of heat from a heat source disposed in the fixing roller, and pressure corresponding to pressing force from the pressure roller, the toner image is melt and caused to permeate the sheet. The phenomenon in which the toner image is melt and permeates the sheet is the same in a fixing system having the following configuration.

In the belt fixing system, a fixing belt serving as a thermally-conductive member in place of the fixing roller, a pressure roller, rollers around which the belt is wound, and a heat source for the belt are used.

In the film fixing system, a fixing belt serving as a thermally-conductive member in place of the fixing roller, a pressure roller, rollers around which the belt is wound, and a heat source for the belt are used.

The electromagnetic induction heating system uses a configuration in which a heating member includes an electromagnetic induction coil for enhancing heat generation efficiency.

The fixing systems have the following issues required to be solved. The issues are to shorten a warm-up time, and furthermore, to shorten a first print time. In addition, the warm-up time refers to a time required for reaching a predetermined temperature (reload temperature) at which printing can be performed, from a room temperature state, at the time when power is turned on, or the like. In addition, the first print time refers to a required time from when a print request has been received, to when sheet ejection is completed after performing print preparation and a print operation.

In the fixing device, a fixing failure sometimes occurs for the following reasons. The image forming apparatus is an apparatus that can perform high-speed processing. If the number of sheets fixed per unit time, i.e., the number of sheets passing through the fixing device per unit time increases due to the high-speed processing, an amount of heat to be supplied to the sheets moving at high speed needs to be also increased. This is for applying heat with an amount necessary for fixing, to the sheets, in accordance with a fixing-device passage time of the sheets getting shorter.

However, if a necessary amount of heat is not ensured at the beginning of continuous printing, temperature largely drops. If the sheets are passed without the heat reaching the amount necessary for high-speed continuous printing, a fixing failure may occur.

In addition, in accordance with the increasing speed of the image forming apparatus, the number of sheets passing per unit time increases, and a necessary amount of heat increases. Thus, an amount of heat becomes insufficient especially at the beginning of continuous printing. Such a so-called temperature drop sometimes becomes a disadvantage, leading to a disadvantage of a fixing failure caused in high-speed processing.

On the other hand, aside from the fixing systems mentioned above, there is a fixing system referred to as a surf fixing system that uses a ceramic heater.

The surf fixing system uses a configuration in which only a nip is locally heated, and other portions are not heated. In this fixing system, as compared with a belt-type fixing device, low heat capacity and downsizing can be achieved. Thus, a time required for rising to a predetermined temperature and a first print time can be shortened. The fixing system, however, has the following disadvantage.

More specifically, the surf fixing system has such a disadvantage that the fixing belt is in the coldest state at the entry of sheets or the like of the nip because portions other than the local point are not heated, and a fixing failure easily occurs. In particular, in a high-speed device, there is such a disadvantage that, because the fixing belt rotates at high speed, and the amount of heat released at the portions of the belt that are other than the nip becomes larger, a fixing failure occurs more easily.

Thus, for coping with such a disadvantage, in the configuration using a fixing belt, there is proposed a fixing device that can achieve good fixability even when being mounted on a high-producing image forming apparatus.

Figure 2:
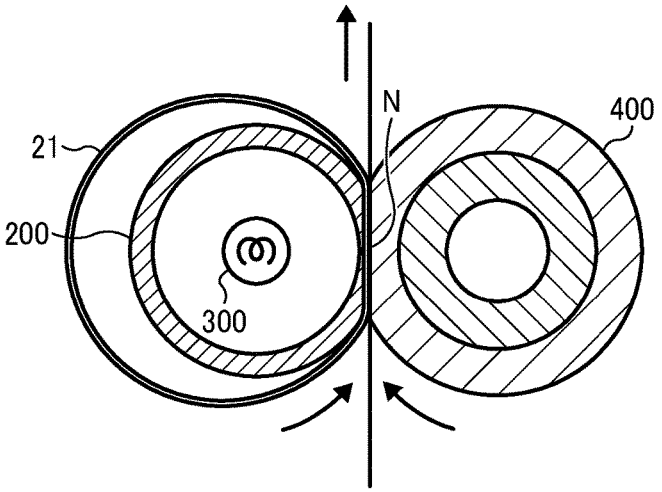
FIG. 2 is a diagram illustrating an example of a fixing device according to a comparative example, to indirectly heat a fixing belt via a metal heat conductor.

For example, a fixing device according to a comparative example has a configuration as illustrated in FIG. 2. The fixing device includes a fixing belt 21, a pipy metal heat conductor 200 disposed in the fixing belt 21, a heat source 300 disposed in the metal heat conductor 200, and a pressure roller 400 that abuts on the metal heat conductor 200 via the fixing belt 21 to form a fixing nip N.

The fixing belt 21 rotates in accordance with the rotation of the pressure roller 400, and at this time, the metal heat conductor 200 guides the movement of the fixing belt 21. In addition, the entire fixing belt 21 can be heated by the fixing belt 21 being heated by the heat source 300 in the metal heat conductor 200 via the metal heat conductor 200. With such a configuration, a first print time from the time of heating standby can be shortened, and the deficiency of a heat amount at the high-speed rotation can be solved.

However, for further saving energy and improving a first print time, heat efficiency needs to be further improved.

Thus, a configuration of directly heating a fixing belt is employed, instead of the configuration of indirectly heating a fixing belt via a metal heat conductor (the metal heat conductor 200 in FIG. 2). With such a configuration, power consumption can be reduced, and a first print time from the time of heating standby can be further shortened. In addition, because a metal heat conductor is not provided, cost saving can be expected.

Figure 3:
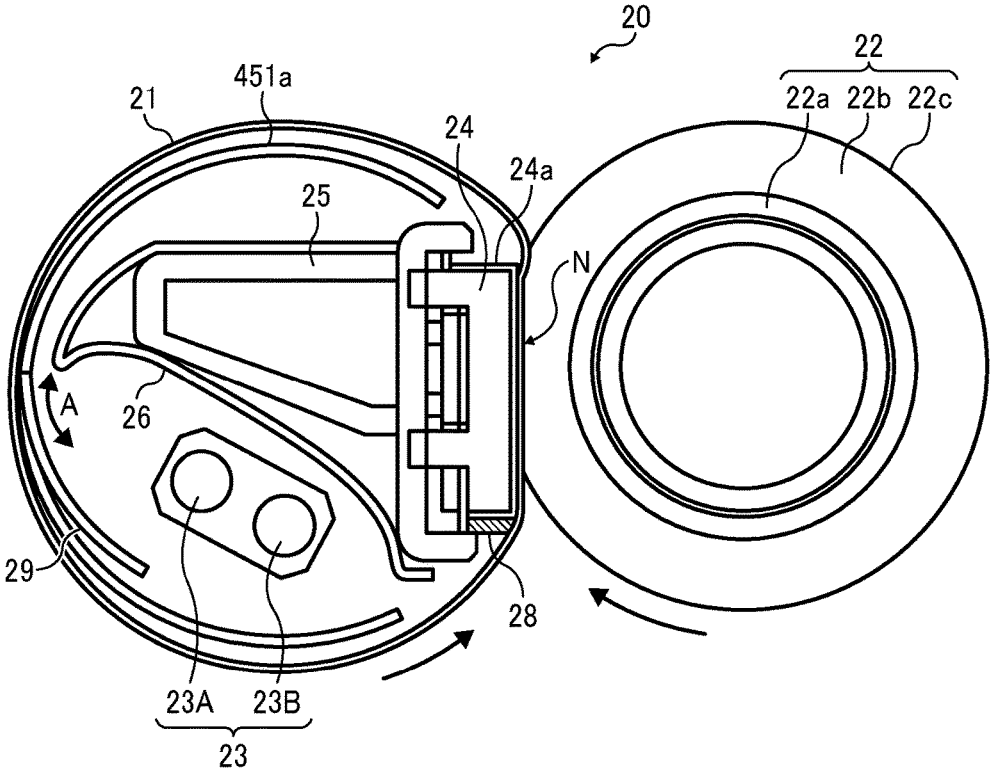
FIG. 3 is a schematic view illustrating a configuration of an example of a fixing device according to an embodiment of the present disclosure.

FIG. 3 is a schematic view illustrating a configuration of an example of the fixing device 20 according to the present embodiment. The fixing device 20 includes a fixing belt 21 serving as a fixing rotator being an endless moving member with a hollow internal structure, and a pressure roller 22 serving as a pressure rotator that is rotatably disposed opposing the fixing belt 21.

On the inner side of the fixing belt 21, there are disposed a heating device 23 serving as a heat source that heats the fixing belt 21, and a nip formation pad 24 that forms a fixing nip N with the pressure roller 22 opposing via the fixing belt 21. Furthermore, on the inner side of the fixing belt 21, there are disposed a stay 25 serving as a support that supports the nip formation pad 24, and a reflector 26 that reflects light radiated from two halogen heaters 23A and 23B included in the heating device 23, to the fixing belt 21.

In addition, a guide portion 451*a* of a flange 451 (refer to FIGS. 4A and 4B) serving as a guide member is inserted into each end of the fixing belt 21 in the width direction of the fixing belt 21, so that the fixing belt 21 is guided and rotatably held by the guide portions 451*a*. In addition, a shield 29 is disposed on the inner side of the fixing belt 21, and the shield 29 is formed to move along the inner circumferential face of the fixing belt 21 as indicated by arrow A in FIG. 3, in non-contact with the fixing belt 21.

A thin endless belt member (including films) having flexibility is used for the fixing belt 21. The fixing belt 21 has a base material of the inner circumferential side that is made of metal material such as nickel or stainless steel (SUS), or resin material such as polyimide (PI). In addition, the fixing belt 21 has a release layer on the outer circumferential side that is made of tetrafluoroethylene-perfluoroalkylvinylether copolymer (PFA), polytetrafluoroethylene (PTFE), or the like.

In addition, an elastic layer made of rubber material such as silicone rubber, foam silicone rubber, or fluorine-containing rubber may be interposed between the base material and the release layer. If the elastic layer is not provided, a heat capacity becomes small and fixability increases, but there arises such a failure that, when an unfixed image is pressed and fixed, subtle irregularities on the belt surface are transferred onto an image, and orange-peel marks remain in a solid portion of the image. For improving this, it is preferable to provide the elastic layer of silicone rubber or the like, for 100 μm or more. The deformation of the elastic layer absorbs the subtle irregularities, and the orange-peel image is improved.

The pressure roller 22 includes a cored bar 22*a*, an elastic layer 22*b*, and a release layer 22*c*. In addition, the elastic layer 22*b* is disposed on the surface of the cored bar 22*a*, and foam silicone rubber, silicone rubber, or fluorine-containing rubber is used for the elastic layer 22*b*. In addition, the release layer 22*c* is disposed on the surface of the elastic layer 22*b*, and PFA, PTFE, or the like is used for the release layer 22*c*.

The pressure roller 22 abuts on the nip formation pad 24 via the fixing belt 21 by being pressed by a pressing unit such as a spring, toward the fixing belt 21 side. By the elastic layer 22*b* of the pressure roller 22 being pressed flat, the fixing nip N with a predetermined width is formed at a location where the pressure roller 22 and the fixing belt 21 are pressed against each other.

The pressure roller 22 is driven to rotate by drive force being transmitted via a gear from a drive source such as a motor that is disposed in a printer body. If the pressure roller 22 is driven to rotate, the drive force is transmitted to the fixing belt 21 at the fixing nip N, and the fixing belt 21 rotates in accordance with the rotation.

In the present embodiment, the pressure roller 22 is assumed to be a solid roller, but may be a hollow roller. In this case, a heat source such as a halogen heater may be disposed inside the pressure roller 22. In addition, if the elastic layer is not provided, a heat capacity becomes small and fixability increases. In addition, the elastic layer 22*b* may be solid rubber. However, if a heat source is not disposed inside the pressure roller 22, sponge rubber may be used. Sponge rubber is more desirable because heat insulating properties increase and the heat of the fixing belt 21 becomes difficult to be lost.

The heating device 23 includes the first halogen heater 23A and the second halogen heater 23B as heat sources, and the both ends are secured on the side plates of the fixing device 20. Each of the halogen heaters 23A and 23B generates heat by being output-controlled by a power source disposed in the printer body. The output control is performed based on a detection result of the surface temperature of the fixing belt 21 that is obtained by a temperature detection sensor.

By such output control of the halogen heaters 23A and 23B, the temperature (fixing temperature) of the fixing belt 21 can be maintained at a desired temperature. In addition, aside from the halogen heaters, an induction (electromagnetic induction) heater (IH), a resistance heat generator, a carbon heater, or the like may be used as a heat source for heating the fixing belt 21.

The nip formation pad 24 is a member for determining the shape of the fixing nip N by receiving pressing force of the pressure roller 22. Thus, the nip formation pad 24 is disposed in parallel with an axial direction of the fixing belt 21 or an axial direction of the pressure roller 22, and secured and supported by the stay 25 used as a support of the nip formation pad 24.

By supporting the nip formation pad 24 using the stay 25 in this manner, deflection is prevented from being generated in the nip formation pad 24 by the pressure applied by the pressure roller 22, and a uniform nip width is obtained in parallel with the axial direction of the pressure roller 22.

In addition, for satisfying the function of preventing the deflection of the nip formation pad 24, the stay 25 is desirably made of metal material having high mechanical strength, such as stainless steel and iron. However, the stay 25 can be made of resin.

In addition, in the present embodiment, the shape of the fixing nip N is planar. Alternatively, the fixing nip N may have a recessed shape or other shapes. If the shape of the fixing nip N is a recessed shape, an ejection direction of the leading end of the sheet P becomes closer to the pressure roller 22, so that separability increases and the occurrence of paper jam is prevented.

In addition, a slide member 24*a* serving as a lubricant impregnated member impregnated with lubricant is attached to the surface of the nip formation pad 24. The slide member 24*a* absorbs the lubricant by a capillary action using a sheet made of fine fluorine fibers having heat resistance.

Examples of the lubricant include silicone oil. Silicone oil is desirable from the aspects of heat resistance, durability, and lubrication capacity, and is good because oils with various viscosities can be selected according to use conditions. As other lubricants, there are fluorine-containing grease and silicone-containing grease.

Aluminum, stainless steel, or the like that makes the surface usable as a reflection surface is used for the reflector 26, and the reflector 26 is disposed between the stay 25 and the heating device 23. Here, the reflector 26 is desirably made of metal material or the like that has a high melting point because the reflector 26 is directly heated by the heating device 23.

By the reflector 26 being disposed between the stay 25 and the heating device 23, light radiated from the halogen heaters 23A and 23B of the heating device 23 to the stay 25 side is reflected to the fixing belt 21. As a result, an amount of light emitted onto the fixing belt 21 can be made larger, and the fixing belt 21 can be efficiently heated.

In addition, because radiation heat from the halogen heaters 23A and 23B can be prevented from being transmitted to the stay 25 or the like, energy saving can also be achieved. In addition, a reflection surface may be formed by polishing the surface on the heating device 23 side of the stay 25 or performing mirror surface processing such as painting on the surface, instead of providing the reflector 26 as in the present embodiment.

However, for ensuring the strength of the stay 25, the shape and the material of the stay 25 cannot be freely selected. Thus, separately providing the reflector 26 as in the present embodiment enhances the flexibility in the selection of the shape and material. In addition, the reflector 26 and the stay 25 can be dedicated for their functions.

In addition, by the reflector 26 disposed between the heating device 23 and the stay 25, the position of the reflector 26 becomes closer to the heating device 23, so that the fixing belt 21 can be efficiently heated.

The shield 29 is disposed between the fixing belt 21 and the heating device 23. The shield 29 can move between a shielding position where the shield 29 shields radiation heat from the halogen heaters 23A and 23B to a non-sheet-passage area of the fixing belt 21, and a retreat position where the shield 29 retreats from this shielding position. With such a configuration, an excessive temperature rise in the non-sheet-passage area of the fixing belt 21 especially in continuous sheet passage can be prevented, and the degradation and damages caused by the heat of the fixing belt 21 can be prevented.

In addition, an operation of moving the shield 29 between the shielding position and the retreat position is performed by drive force from a drive source included in a driving device serving as a driver controlled by a controller.

The shield 29 is formed by forming a metal plate with a thickness of 0.1 [mm] to 1.0 [mm], in an arc-like cross-sectional shape following the inner circumferential face of the fixing belt 21. In addition, the shield 29 is movable in the circumferential direction of the fixing belt 21.

Figure 4A:
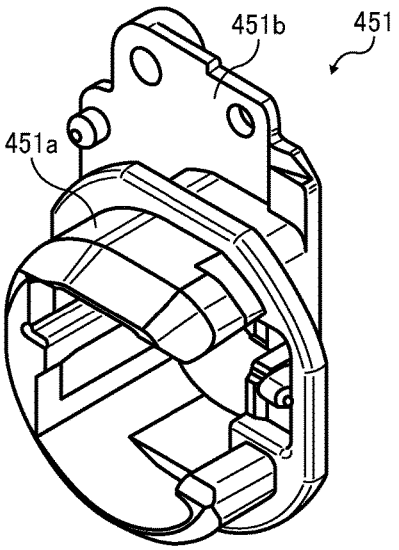
FIG. 4A is a perspective view of a flange according to an embodiment of the present disclosure.
Figure 4B:
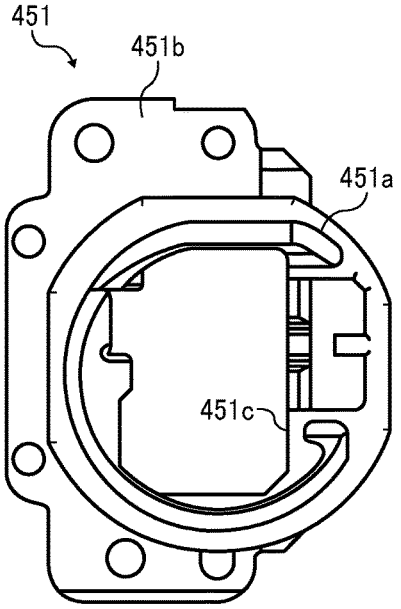
FIG. 4B is a front view of the flange according to an embodiment of the present disclosure.

FIG. 4A is a perspective view of the flange 451, and FIG. 4B is a front view of the flange 451. The flanges 451 disposed at both ends of the width direction of the fixing belt 21 have the same shape. As illustrated in FIGS. 4A and 4B, the flange 451 includes an attachment portion 451*b* to be attached to the side plate of the fixing device 20, and the guide portion 451*a* opposing one end of the inner circumferential face of the fixing belt 21.

The guide portion 451*a* has substantially cylindrical shape with a pressure roller side being cutout. The guide portion 451*a* has an outer diameter substantially equal to an inner diameter of the fixing belt 21, and has a length for entering inward from both ends of the fixing belt 21 by a predetermined amount. In other words, the guide portion 451*a* is formed to be a circumferential guide projection, and maintains the cross-sectional shape of the fixing belt 21 to be a circular shape by being inserted into each end of the fixing belt 21 in the width direction and slidingly moved.

A through-hole 451*c* is disposed at a location corresponding to the inner side of the guide portion 451*a* of the attachment portion 451*b*. The stay 25 and the heating device 23 are attached to the side plate of the fixing device 20 by penetrating through the through-hole 451*c*.

The fixing device 20 according to the present embodiment has various ingenious features in the configuration for further saving energy and improving the first print time or the like.

Specifically, the fixing belt 21 can be directly heated by the heating device 23 at a location other than the fixing nip N (direct heating system). In addition, for making the heat capacity of the fixing belt 21 low, the fixing belt 21 is formed to be thin, and to have a small diameter.

In addition, in the present embodiment, members that contact the inner circumferential face of the fixing belt 21 are the guide portion 451*a* of the flange 451 and the nip formation pad 24 only. A belt guide that guides the rotation in contact with the inner circumferential face of the fixing belt 21 does not exist other than these members.

A basic operation of the fixing device 20 according to the present embodiment will be described below referring to FIG. 3.

If a power switch of the printer body is input, power is supplied to the halogen heaters 23A and 23B, and the pressure roller 22 is started to be driven to rotate in a clockwise direction in FIG. 3. As a result, the fixing belt 21 rotates in accordance with the rotation, in a counterclockwise direction in FIG. 3, by frictional force generated between itself and the pressure roller 22.

After that, the sheet P on which an unfixed toner image T is borne through the above-described image forming step is fed into the fixing nip N of the fixing belt 21 and the pressure roller 22 that are in a pressed state. Then, the toner image T is fixed onto the surface of the sheet P by the heat of the fixing belt 21 heated by the heating device 23, and pressing force generated between the fixing belt 21 and the pressure roller 22.

The sheet P on which the toner image T has been fixed is discharged from the fixing nip N, and the discharged sheet P is ejected to the outside of the apparatus by the paired sheet ejection rollers 7 (refer to FIG. 1) as described above, and stocked on the sheet ejection tray 17 (refer to FIG. 1).

Next, the shield 29 disposed between the fixing belt 21 and the heating device 23 will be specifically described.

Figure 5:
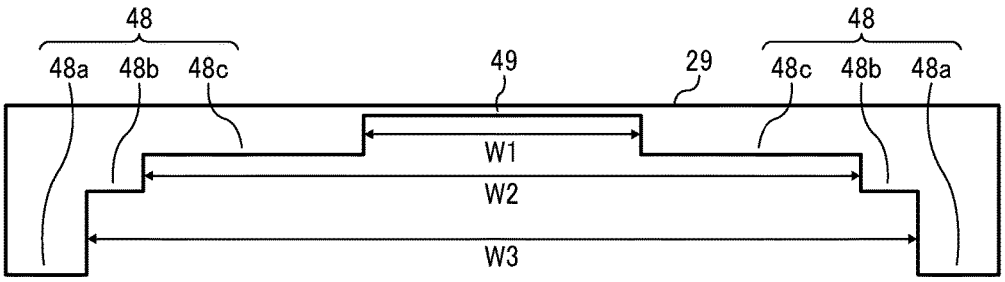
FIG. 5 is a plan view of a shield according to an embodiment of the present disclosure.

FIG. 5 illustrates a plan view of the shield 29. As illustrated in FIG. 5, the shield 29 has shielding portions 48 formed in a shape having 3 step portions, on each of the both ends. More specifically, each of the shielding portions 48 includes a first shielding area 48*a*, a second shielding area 48*b*, and a third shielding area 48*c*. In addition, the third shielding areas 48*c* of the respective shielding portions 48 are connected via a connector 49.

In the present embodiment, a width W1 between the third shielding areas 48*c* corresponds to a small-sized sheet passage width, a width W2 between the second shielding areas 48*b* corresponds to a middle-sized sheet passage width, and a width W3 between the first shielding areas 48*a* corresponds to a large-sized sheet passage width. In the present embodiment, the small-sized sheet passage width corresponds to the width of a "postcard", and the middle-sized sheet passage width corresponds to the width of the "B4 size". In addition, the large-sized sheet passage width corresponds to the width of the "A3 size". In addition, examples of sheet sizes corresponding to the sheet passage widths are not limited to these sizes.

Figure 6:
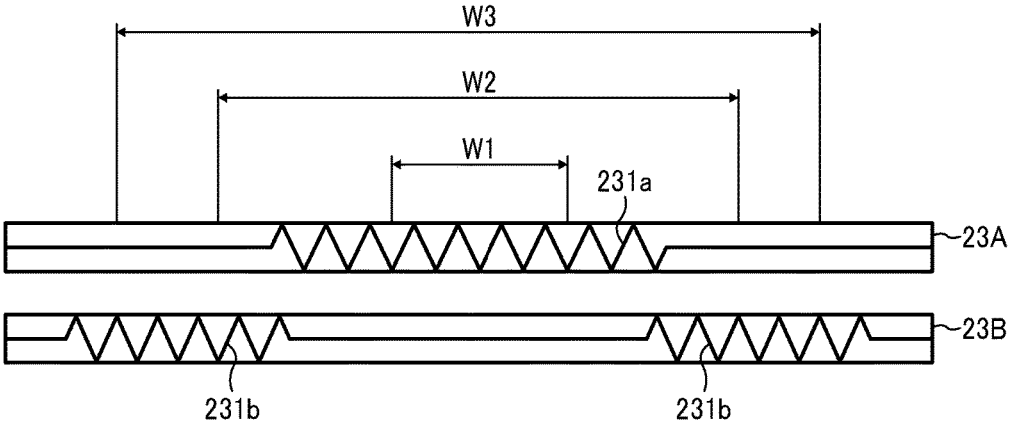
FIG. 6 is a diagram illustrating heat generators of respective halogen heaters according to an embodiment of the present disclosure.

FIG. 6 is a diagram illustrating heat generators of the respective halogen heaters 23A and 23B. In the present embodiment, the lengths and the arrangement positions of the heat generators of the respective halogen heaters 23A and 23B are made different. More specifically, as illustrated in FIG. 6, a heat generator 231*a* of the first halogen heater 23A is disposed on the central part side in a longitudinal direction, and heat generators 231*b* of the second halogen heater 23B are disposed on both end sides in the longitudinal direction. The heat generator 231*a* of the first halogen heater 23A corresponds to a range equal to or larger than the above-described small-sized sheet passage width W1, and smaller than the above-described middle-sized sheet passage width W2. In addition, the heat generators 231*b* of the second halogen heater 23B are disposed in a range equal to or larger than the middle-sized sheet passage width W2, and including the large-sized sheet passage width W3.

Figure 7:
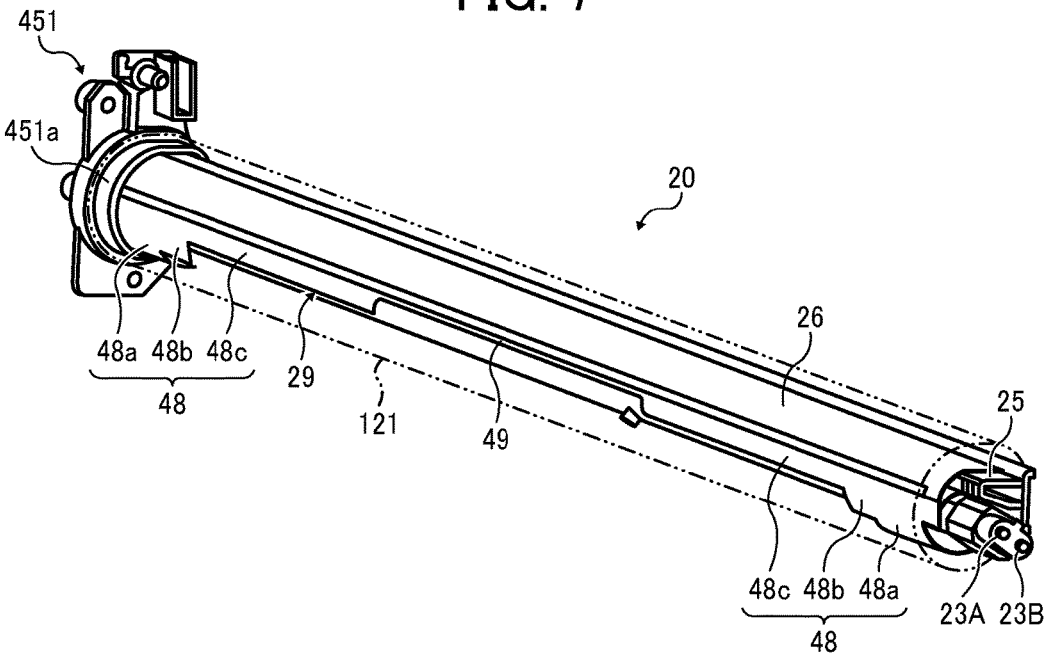
FIG. 7 is a perspective view of the fixing device when a small-sized sheet is passed, according to an embodiment of the present disclosure.
Figure 8:
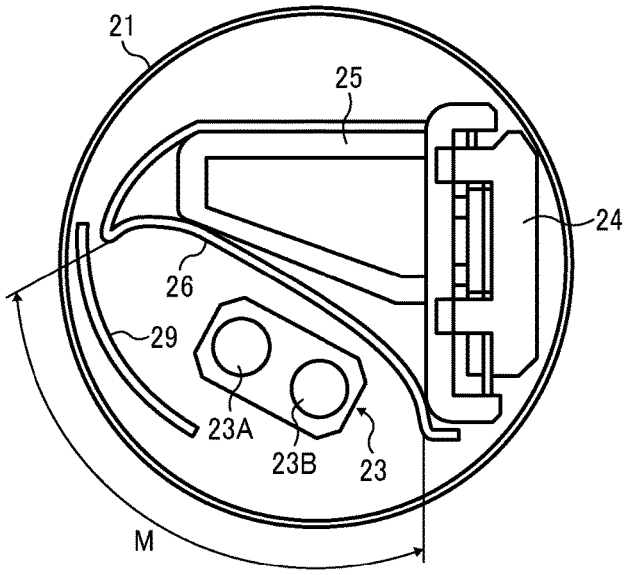
FIG. 8 is a cross-sectional view of the fixing device when a small-sized sheet is passed, according to an embodiment of the present disclosure.

FIG. 7 is a perspective view of the fixing device 20 when a small-sized sheet is passed. FIG. 8 is a cross-sectional view of the fixing device 20 when a small-sized sheet is passed.

The width W1 between the third shielding areas 48*c* that corresponds to the small-sized sheet having a sheet width equal to or smaller than the width of a "postcard" corresponds to a range smaller than the length of the heat generator 231*a* of the first halogen heater 23A. Thus, when the small-sized sheet is passed, only the first halogen heater 23A is caused to generate heat. However, in this case, a range of the fixing belt 21 that is to be heated by the first halogen heater 23A exceeds the small-sized sheet passage width W1. Thus, the shield 29 is moved to the shielding position corresponding to the small-sized sheet passage width W1.

More specifically, as illustrated in FIG. 8, the shield 29 is moved to the shielding position corresponding to the small-sized sheet, in which a portion up to the third shielding areas 48*c* is positioned in a direct heating area M of the heating device 23. With such a configuration, a range outside the vicinity of the ends of the small-sized sheet passage width W1 can be shielded by the first, second, and third shielding areas 48*a*, 48*b*, and 48*c*. Thus, the fixing belt 21 is not directly heated by the halogen heaters 23A and 23B at least when the non-sheet-passage area of the fixing belt 21 passes through the portion shielded by the first, second, and third shielding areas 48*a*, 48*b*, and 48*c*. As a result, as compared with a case in which the fixing belt 21 is not shielded by the shield 29, a temperature rise of the fixing belt 21 in the non-sheet-passage area can be prevented.

Next, when the middle-size sheet having a sheet width larger than the width of the "postcard" and equal to or smaller than the width of the "B4 size" is passed, both of the first halogen heater 23A and the second halogen heater 23B are caused to generate heat. In this case, if the first halogen heater 23A and the second halogen heater 23B are caused to generate heat, a range of the fixing belt 21 that is to be heated exceeds the middle-sized sheet passage width W2.

Thus, when the middle-size sheet is passed, the shield 29 is moved to the shielding position corresponding to the middle-sized sheet passage width. More specifically, the third shielding areas 48*c* are retracted from the direct heating area M, and the first shielding areas 48*a* and the second shielding areas 48*b* are positioned in the direct heating area M. With such a configuration, a range outside the vicinity of the ends of the middle-sized sheet passage width W2 can be shielded by the first shielding areas 48*a* and the second shielding areas 48*b*. As a result, the fixing belt 21 is not directly heated by the halogen heaters 23A and 23B at least when the non-sheet-passage area of the fixing belt 21 passes through the portion shielded by the second shielding areas 48*b* and the first shielding areas 48*a*. As a result, as compared with a case in which the fixing belt 21 is not shielded by the shield 29, a temperature rise of the fixing belt 21 in the non-sheet-passage area can be prevented.

Figure 9:
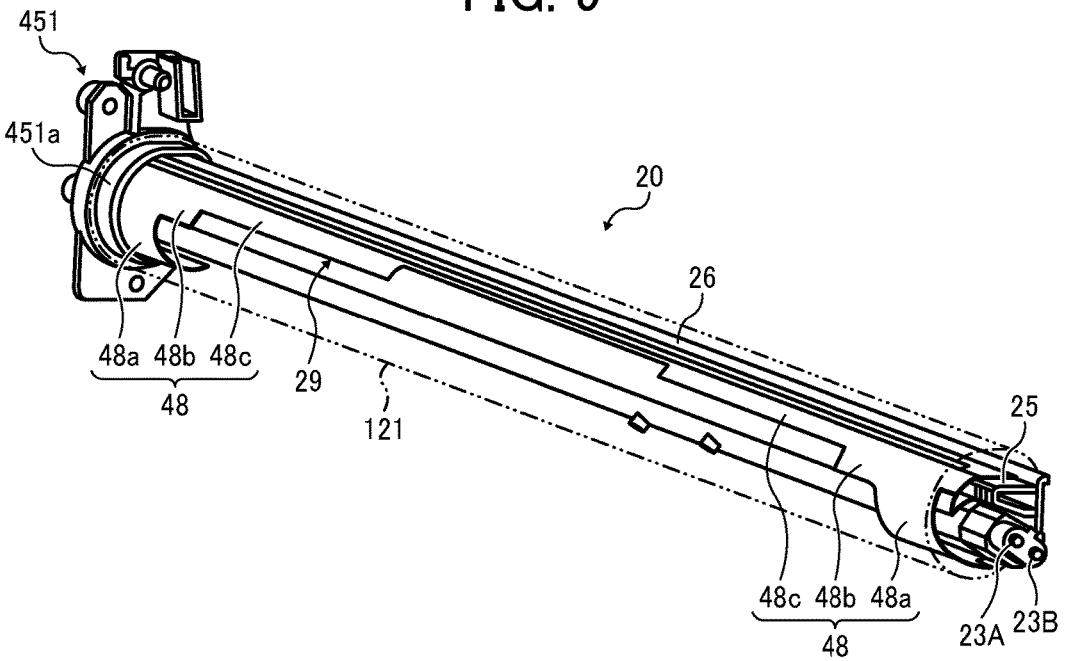
FIG. 9 is a perspective view of the fixing device when a large-sized sheet is passed, according to an embodiment of the present disclosure.
Figure 10:
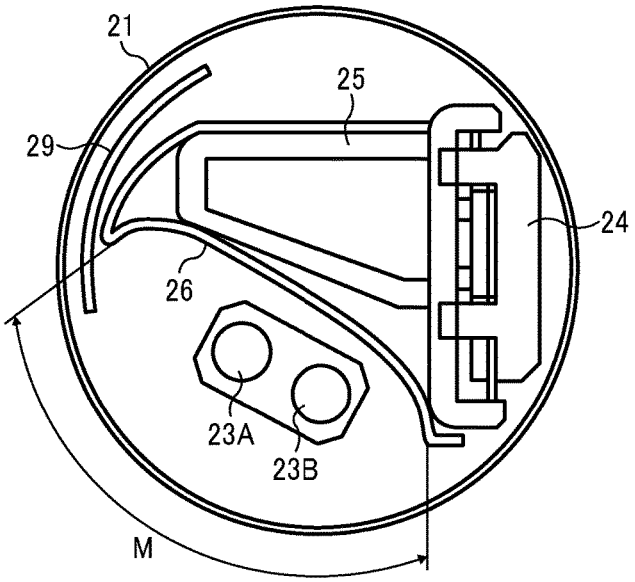
FIG. 10 is a cross-sectional view of the fixing device when a large-sized sheet is passed, according to an embodiment of the present disclosure.

FIG. 9 is a perspective view of the fixing device 20 when a large-sized sheet is passed. FIG. 10 is a cross-sectional view of the fixing device 20 when a large-sized sheet is passed.

When the large-sized sheet having a width exceeding the width of the "B4 size" is passed, both the halogen heater 23A and the halogen heater 23B are caused to generate heat. In this case, if the halogen heater 23A and the halogen heater 23B are caused to generate heat, a range of the fixing belt 21 that is to be heated exceeds the large-sized sheet passage width W3.

Thus, when the large-sized sheet is passed, the shield 29 is moved to the shielding position for the large-sized sheet. More specifically, as illustrated in FIG. 10, the shield 29 is moved so that the second shielding areas 48*b* and the third shielding areas 48*c* are retracted from the direct heating area M, and only the first shielding areas 48*a* is positioned in the direct heating area M.

With such a configuration, the fixing belt 21 is not directly heated by the halogen heaters 23A and 23B at least when the non-sheet-passage area of the fixing belt 21 passes through the portion shielded by the first shielding areas 48*a*. As a result, as compared with a case in which the fixing belt 21 is not shielded by the shield 29, a temperature rise of the fixing belt 21 in the non-sheet-passage area can be prevented.

In addition, when a sheet having the largest size passable by the this printer, such as A3+, is passed, the third shielding areas 48*c* are also retracted from the direct heating area M.

In this manner, by providing the shield 29, even if sheets having a width narrower than the halogen heaters 23A and 23B in the width direction of the fixing belt 21 are continuously passed, the non-sheet-passage area of the fixing belt 21 can be prevented from entering an excessive temperature rise state. With such a configuration, there is no need to perform control of decreasing productivity or the like, for canceling an excessive temperature rise area.

Figure 11:
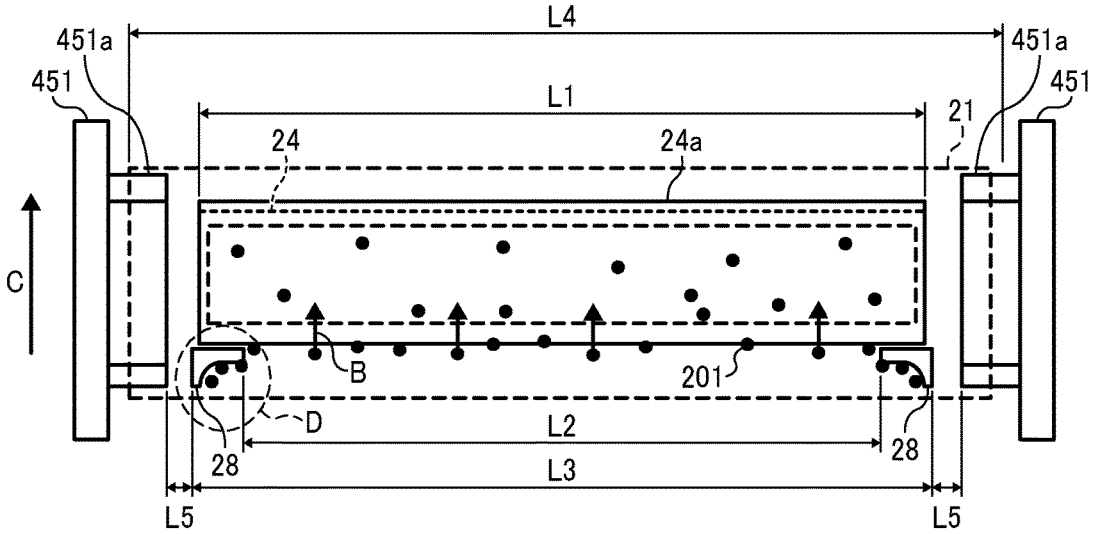
FIG. 11 is a schematic view of a vicinity of a nip formation pad viewed from a pressure roller side, according to an embodiment of the present disclosure.

Next, the characteristic points of the present embodiment will be described. FIG. 11 is a schematic view of the vicinity of the nip formation pad 24 viewed from the pressure roller side. In addition, the rotation direction of the fixing belt 21 is indicated by arrow C in FIG. 11. As illustrated in FIG. 11, a length L1 in the longitudinal direction (width direction of the fixing belt 21) of the slide member 24*a* is shorter than a length between the guide portions 451*a* of the flanges 451. In addition, predetermined spaces L5 are disposed between the ends of the guide portions 451*a* and the longitudinal ends of the nip formation pad 24. In the present embodiment, a width L4 of the fixing belt 21 is 360 mm, a length L1 in the longitudinal direction (width direction of the fixing belt 21) of the slide member 24*a* is 344 mm, and the spaces L5 between the ends of the guide portions 451*a* and the longitudinal ends of the nip formation pad 24 are 5 mm.

The slide member 24*a* serving as a lubricant impregnated member impregnated with lubricant 201 such as silicone oil is attached to the surface of the nip formation pad 24. By the slide member 24*a* being pressed by the pressure roller 22 via the fixing belt 21, the lubricant 201 with which the slide member 24*a* is impregnated is squeezed out, and adheres to the inner circumferential face of the fixing belt 21. The lubricant 201 adhering to the inner circumferential face of the fixing belt 21 goes around the fixing belt 21 while adhering thereto, and is dammed at the upstream end of the nip formation pad 24 in the rotation direction C of the fixing belt 21. After that, the lubricant 201 is absorbed into the slide member 24*a* as indicated by arrow B in FIG. 11.

However, when the lubricant 201 is dammed at the upstream end of the nip formation pad 24 in the rotation direction C of the fixing belt 21, the lubricant 201 sometimes moves toward the end of the fixing belt 21. Then, if the lubricant 201 moves to the outer side of the longitudinal end of the slide member 24*a*, the lubricant 201 is not absorbed into the slide member 24*a*. As a result, the lubricant 201 contained in the slide member 24*a* gradually decreases, and the lubrication effect caused by the lubricant 201 is lost, so that a torque of the fixing device 20 rises.

In addition, the lubricant 201 that has moved to the outer side of the longitudinal end of the slide member 24*a* is no longer dammed by the nip formation pad 24, and goes around again together with the fixing belt 21. In addition, there has been a possibility that the lubricant 201 that has moved to the outer side of the longitudinal end of the slide member 24*a* moves toward the end of the fixing belt 21, adheres to the guide portion 451*a* of the flange 451, and finally, leaks from the end of the fixing belt 21.

Thus, in the present embodiment, there are provided restrictors 28 to regulate the movement of the lubricant 201 toward both ends of the fixing belt. The restrictors 28 are disposed at both longitudinal ends of an upstream end face of the nip formation pad 24 in the rotation direction C of the fixing belt 21. The restrictors 28 are formed of heat-resistant elastic material such as fluorine-containing rubber, and are formed of a material having a lower absorbability of the lubricant 201 than an absorbability of the slide member 24*a*.

In addition, the "absorbability" refers to the absorbency of lubricant in a liquid state, and the "absorbability" of material can be evaluated by using a test method such as, for example, a dropping test, Byreck method, and a precipitation method, as in "the water absorption property test method of textile products of JIS L 1907". For example, the evaluation of "absorbability" using the Byreck method is performed in the following manner. More specifically, a test specimen in the size of 200 mm in a lengthwise direction×25 mm in a traverse direction is prepared using an absorber (a sample), and an upper end of the test specimen is secured so as to be vertical. Next, a lower end is immersed into liquid lubricant such as oil, and a height Hmm by which the liquid left for 10 minutes has risen in the absorber is measured. As the rise height Hmm is higher, the "absorbability" of the lubricant can be said to be high. In addition, the evaluation of "absorbability" of material is not limited to the above-described methods, and can be appropriately selected.

A distance L2 from an inner end of one of the restrictors 28 to an inner end of the other one of the restrictors 28 is longer than the largest sheet width passable by the this printer. In the present embodiment, the above-described distance L2 is 322 mm. In addition, a distance L3 from an outer end of one of the restrictors 28 to an outer end of the other one of the restrictors 28 is 350 mm in the present embodiment, and is longer than the longitudinal length L1: 344 mm of the slide member 24*a*. In other words, the outer end of each of the restrictors 28 is positioned on an outer side than the longitudinal end of the slide member 24*a*.

Figure 12:
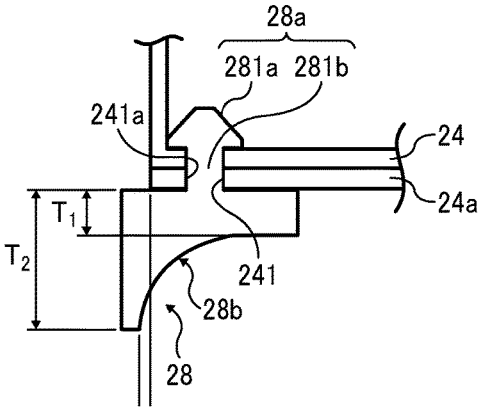
FIG. 12 is an enlarged cross-sectional view of a portion enclosed by a broken line D in FIG. 11, according to an embodiment of the present disclosure.

FIG. 12 is an enlarged cross-sectional view of a portion enclosed by broken line D in FIG. 11. The restrictor 28 includes an attachment portion 28*a* for attaching to the nip formation pad 24. The attachment portion 28*a* includes a cylindrical penetration portion 281*b* and a stopper portion 281*a*. The stopper portion 281*a* is disposed at the leading end of the penetration portion 281*b*, and has such a trapezoidal cross-sectional shape that the diameter becomes larger from the leading end side toward the penetration portion 281*b*.

The nip formation pad 24 has a hollow box shape. A through-hole 241 having an inner diameter slightly larger than the outer diameter of the penetration portion 281*b* is formed in the vicinity of a longitudinal end of an upstream wall surface of the nip formation pad 24 in the rotation direction C of the fixing belt 21. In addition, a through-hole 241*a* is also disposed in the vicinity of the longitudinal end of a portion of the slide member 24*a* attached to an upstream wall surface of the nip formation pad 24 in the rotation direction C of the fixing belt 21, so as to be overlapped with the through-hole 241 of the nip formation pad 24.

When the restrictor 28 is attached, first, the restrictor 28 is pushed into the slide member 24*a* side while pressing the leading end of the stopper portion 281*a* against the through-hole 241*a* of the slide member 24*a*. Then, the stopper portion 281*a* is compressed and deformed to be inserted into the through-hole 241*a* of the slide member 24*a*. Furthermore, the restrictor 28 is pushed in, and when the stopper portion 281*a* goes out of the through-hole 241 of the nip formation pad 24, the stopper portion 281*a* returns to an original shape. The restrictors 28 are thereby attached to the nip formation pad 24.

The restrictor 28 has such a substantially-L-shape that an outer end of the restrictor 28 is positioned upstream from an inner end of the restrictor 28 in the rotation direction C of the fixing belt 21. Specifically, a thickness of the inner end of restrictor 28 becomes $T_1$, and the thickness gradually increases from the inner end toward the outer side, and the thickness of the outer end becomes $T_2$. In addition, an upstream surface of the restrictor 28 in the rotation direction C of the fixing belt 21 is an inclined surface 28*b* having an R shape gradually inclined toward the a downstream side in the rotation direction C of the fixing belt 21 from the outer side toward the inner side of the restrictor 28. In the present embodiment, the surface is an R-shaped inclined surface. However, in some embodiments, the surface may be a linear inclined surface.

As illustrated in FIG. 11 mentioned above, in the present embodiment, the restrictors 28 are disposed at both ends of the longitudinal direction of the nip formation pad 24. Thus, the lubricant 201 dammed at the upstream end of the nip formation pad 24 can be regulated so as not to move to the outer side of the longitudinal ends of the slide member 24*a*. With such a configuration, the lubricant 201 dammed at the upstream end of the nip formation pad 24 can be absorbed in the slide member 24*a*. As a result, a circulation cycle in which the lubricant 201 adhering to the fixing belt 21 from the slide member 24*a* returns to the slide member 24*a* can be established. Thus, the decrease in the lubricant 201 contained in the slide member 24*a* can be prevented over time, and the lubrication effect caused by the lubricant 201 can be maintained over time. As a result, a rise in the torque of the fixing device 20 can be prevented over time.

In addition, the upstream surface of the restrictor 28 in the rotation direction C of the fixing belt 21 is the inclined surface 28*b* having the R shape gradually inclined toward the downstream side in the rotation direction C of the fixing belt 21 from the outer side toward the inner side of the restrictor 28. With such a configuration, the lubricant 201 adhering from the slide member 24*a* to an outer side of the inner circumferential face of the fixing belt 21 than the inner end of the restrictor 28 can be guided by the inclined surface 28*b* to the inner side of the restrictor 28. In addition, the lubricant 201 that has moved to the outer side than the inner end of the restrictor 28 can be guided by the inclined surface 28*b* to the inner side of the restrictor 28, while the lubricant 201 is dammed at the upstream end of the nip formation pad 24. As a result, the lubricant 201 on the outer side than the inner end of the restrictor 28 can be brought into contact with the slide member 24*a*, and absorbed again into the slide member 24*a*.

On the outer side than the inner end of the restrictor 28, the lubricant 201 does not contact the slide member 24*a*. Thus, in an area of the slide member 24*a* that is on the outer side than the inner end of the restrictor 28, the lubricant 201 is not absorbed. When the sheet passes through the fixing nip N, in a sheet passage area, a contact pressure of the fixing belt 21 and the nip formation pad 24 becomes higher than that in the non-sheet-passage area by an amount corresponding to the thickness of the sheet, so that friction resistance of the sheet passage area becomes larger.

Thus, in the present embodiment, the restrictors 28 are disposed on the outer side of the largest sheet width passable by this printer. With such a configuration, in the sheet passage area of the slide member 24*a*, the lubricant 201 adhering to the fixing belt 21 is absorbed, and a sufficient amount of the lubricant 201 can be held at least in the sheet passage area of the slide member 24*a*. As a result, the effect of the lubricant 201 can be effectively maintained.

In addition, in the present embodiment, the restrictors 28 are formed of fluorine-containing rubber so that the lubricant 201 is not absorbed into the restrictors 28. If the restrictors 28 are formed of such material as to absorb the lubricant 201, the restrictors 28 store and accumulate the lubricant 201. As a result, the lubricant 201 contained in the slide member 24*a* decreases, and a good lubrication effect may fail to be obtained. In addition, the lubricant 201 absorbed into the restrictors 28 may leak from the outer ends of the restrictors 28. The lubricant 201 leaking from the outer ends may move to the outer side and finally leak from both ends of the fixing belt 21 in the width direction.

By the restrictors 28 being formed of fluorine-containing rubber so that the lubricant 201 is not absorbed into the restrictors 28, the decrease in the lubricant 201 contained in the slide member 24*a* can be prevented, and a situation in which the lubricant 201 leaks from the outer ends of the restrictors 28 can be prevented.

In addition, by the restrictors 28 being made of elastic member such as fluorine-containing rubber, the restrictors 28 can be brought into contact with the fixing belt 21 by being elastically deformed. This can cause the restrictors 28 to follow the position variation of the fixing belt 21, and bring the restrictors 28 into contact with the inner circumferential face of the fixing belt 21 with no space. As a result, an outward movement of the lubricant 201 adhering to the fixing belt 21 can be favorably regulated. In addition, the lubricant 201 adhering to the inner circumferential face of the fixing belt 21 can be returned to the inner side using the inclined surface 28*b*.

In addition, as illustrated in FIG. 12, the outer end of the inclined surface 28*b* of the restrictor 28 is positioned on an outer side than the longitudinal end of the slide member 24*a*. With such a configuration, the lubricant 201 adhering to the fixing belt 21 from the vicinity of the longitudinal end of the slide member 24*a* can be caught by the inclined surface 28*b* of the restrictor 28, and the lubricant 201 can be returned to the inner side so as to contact the slide member 24*a*, using the inclined surface 28*b*. In addition, the lubricant 201 that has moved to the outer side than the longitudinal end of the slide member 24*a* can also be caught by the inclined surface 28*b*, and the lubricant 201 can be returned to the inner side so as to contact the slide member 24*a*, using the inclined surface 28*b*.

In the present embodiment, the restrictor 28 is disposed at the longitudinal end of the slide member 24*a*. The restrictor 28 is preferably disposed on an inner side than the leading end of the guide portion 451*a* of the flange 451. This is because, if the lubricant 201 adheres to the guide portion 451*a*, the lubricant 201 cannot be returned to the inner side using the restrictor 28. By providing the restrictor 28 on the inner side than the leading end of the guide portion 451*a*, the lubricant 201 adhering to the fixing belt 21 can be returned to the inner side, and can be resupplied to the slide member 24*a*. In addition, an inner leading end of the restrictor 28 is preferably disposed on an inner side than the longitudinal end of the slide member 24*a*. With such a configuration, the lubricant 201 that has been regulated by the restrictor 28 can be returned to the slide member 24*a*, and the lubricant 201 adhering to the fixing belt 21 can be resupplied to the slide member 24*a*.

Furthermore, in the present embodiment, the restrictor 28 is disposed at a position adjacent to the nip formation pad 24 at an upstream side from the nip formation pad 24 in the rotation direction C of the fixing belt 21. However, in some embodiments, the restrictor 28 may be disposed at an arbitrary position on the rotational trajectory of the fixing belt 21. Even if the restrictor 28 is not disposed at the position adjacent to the nip formation pad 24 at the upstream side from the nip formation pad 24 in the rotation direction C of the fixing belt 21, outward movement of the lubricant 201 adhering to the fixing belt 21 can be regulated, and the lubricant 201 can be prevented from adhering to the guide portion 451*a*. Furthermore, by returning the lubricant 201 to the inner side of the longitudinal end of the slide member 24*a* using the restrictor 28, the lubricant 201 adhering to the fixing belt 21 can be brought into contact with the upstream end of the slide member 24*a* in the rotation direction C of the fixing belt 21, and can be resupplied to the slide member 24*a*.

Nevertheless, when the lubricant 201 is dammed at the upstream end of the slide member 24*a*, the lubricant 201 easily moves outward. Thus, by providing the restrictor 28 at a position adjacent to the nip formation pad 24 at the upstream side from the nip formation pad 24 in the rotation direction C of the fixing belt 21, the movement of the lubricant 201 can be effectively regulated, which is desirable.

Figure 13:
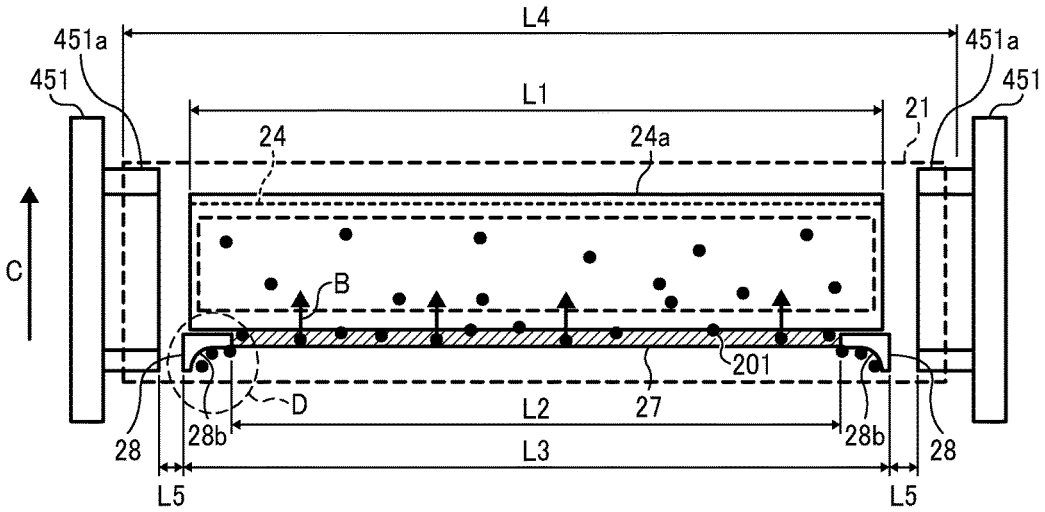
FIG. 13 is a schematic view of a vicinity of a nip formation pad viewed from a pressure roller side, in a fixing device of a variation.
Figure 14:
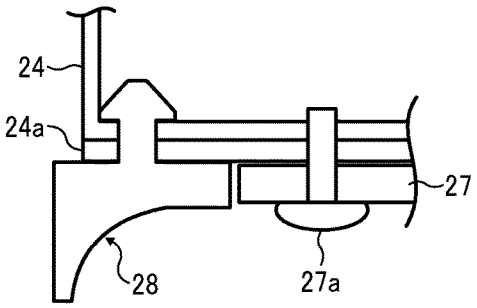
FIG. 14 is an enlarged cross-sectional view of a portion enclosed by a broken line D in FIG. 13.

Next, a variation of the present embodiment will be described. FIG. 13 is a schematic view of a vicinity of the nip formation pad 24 viewed from a pressure roller side, in a fixing device of a variation. FIG. 14 is an enlarged cross-sectional view of a portion enclosed by a broken line D in FIG. 13. As illustrated in FIG. 13, in Variation 1, a lubricant collector 27 serving as a lubricant holder is disposed between the restrictors 28. The lubricant collector 27 is formed of material having higher absorbability of the lubricant 201 than that of the slide member 24*a*, such as superabsorbent polymer.

As illustrated in FIG. 14, both ends of the lubricant collector 27 are attached to the nip formation pad 24 using attachment screws 27*a*. By providing the lubricant collector 27 in this manner, the lubricant 201 can be held by the slide member 24*a* and the lubricant collector 27, so that an amount of the lubricant 201 that can be held can be increased. With such a configuration, the lubrication effect caused by the lubricant 201 can be maintained over time.

The lubricant 201 that has adhered to the inner circumferential face of the fixing belt 21 from the slide member 24*a*, and has moved to the upstream side of the nip formation pad 24 in the rotation direction C of the fixing belt 21 together with the fixing belt 21 with adhering thereto is dammed by the lubricant collector 27, and then, absorbed into and collected by the lubricant collector 27. As described above, the lubricant collector 27 is formed of material having higher absorbability of the lubricant 201 than that of the slide member 24*a*. Thus, the lubricant collector 27 can quickly absorb the dammed lubricant 201.

The lubricant 201 that has been absorbed into the lubricant collector 27 adheres to the inner circumferential face of the belt, and conveyed to the slide member 24*a* according to the rotation of the belt, to be supplied to the slide member 24*a*. In addition, the lubricant 201 in the lubricant collector 27 is supplied to the slide member 24*a* through a contact portion of the lubricant collector 27 and the slide member 24*a*.

In addition, because the restrictors 28 are disposed on the outer sides of the lubricant collector 27, the restrictors 28 can regulate the leakage of the lubricant 201 from the longitudinal ends of the lubricant collector 27. In addition, because the outer ends of the restrictors 28 are positioned on the upstream side of the lubricant collector 27 in the rotation direction C of the fixing belt 21, the movement of the lubricant 201 dammed by the lubricant collector 27, toward the end of the fixing belt 21 can be regulated.

In addition, the lubricant 201 adhering to the outer side of the lubricant collector 27 of the fixing belt 21 can be guided by the inclined surface 28*b* of the restrictor 28, and returned to the lubricant collector 27. With such a configuration, the lubricant 201 adhering to the fixing belt 21 can be collected by the lubricant collector 27.

The above-described effect is an example, and an effect specific to each of the following aspects is brought about.

Aspect 1

A fixing device, such as the fixing device 20, includes a rotatable endless fixing belt, such as the fixing belt 21, a pressure rotator, such as the pressure roller 22, to contact an outer circumferential face of the fixing belt, a nip formation member, such as the nip formation pad 24, disposed on an inner circumferential side of the fixing belt, to abut on the pressure rotator via the fixing belt to form a nip, such as the fixing nip N, and a lubricant impregnated member, such as the slide member 24*a*, disposed on the nip formation member to contact an inner circumferential face of the fixing belt. The lubricant impregnated member is impregnated with lubricant. The fixing device also includes a plurality of restrictors, such as the restrictors 28, to regulate movement of the lubricant adhering to the fixing belt, toward each end of the fixing belt. The plurality of restrictors has a lower absorbability of the lubricant than an absorbability of the lubricant impregnated member and is disposed on an inner side than each end of the fixing belt in a width direction of the fixing belt. With such a configuration, movement of the lubricant adhering to the fixing belt, toward each end of the fixing belt is regulated by the restrictors. Furthermore, because the restrictors have a lower absorbability of the lubricant than the absorbability of the lubricant impregnated member, such as the slide member 24*a*, as compared with a case in which the absorption rate of the lubricant of the restrictors is set to be equal to or larger than the absorption rate of the lubricant of the lubricant impregnated member, the lubricant can be more effectively prevented from being absorbed into the restrictors, and the leakage of the lubricant from the outer ends of the restrictors in the width direction of the fixing belt can be prevented. With such a configuration, the lubricant can be favorably prevented from leaking from the fixing belt.

Aspect 2

A fixing device, such as the fixing device 20, includes a rotatable endless fixing belt, such as the fixing belt 21, a pressure rotator, such as the pressure roller 22, to contact an outer circumferential face of the fixing belt, a nip formation member, such as the nip formation pad 24, disposed at an inner circumferential side of the fixing belt, to abut on the pressure rotator via the fixing belt to form a nip, such as the fixing nip N, a lubricant impregnated member, such as the slide member 24*a*, disposed on the nip formation member to contact an inner circumferential face of the fixing belt. The lubricant impregnated member is impregnated with lubricant. The fixing device further includes a plurality of guide members, such as the flanges 451, to contact the inner circumferential face of the fixing belt at both ends of the fixing belt in a width direction of the fixing belt, to guide rotation of the fixing belt, and a plurality of restrictors, such as the restrictors 28, disposed at an inner side than the plurality of guide members in the width direction of the fixing belt, to restrict movement of the lubricant adhering to the inner circumferential face of the fixing belt, toward an outer side in the width direction of the fixing belt. With such a configuration, the restrictors, which are disposed at the inner side than the guide members in the width direction of the fixing belt, restrict movement of the lubricant adhering to the inner circumferential face of the fixing belt, toward an outer side in the width direction of the fixing belt, thus reducing adhesion of the lubricant adhering to the fixing belt to the guide members. Accordingly, leakage of the lubricant from the guide members can be reduced, thus reducing staining of the fixing device.

Aspect 3

In Aspect 1 or 2, the restrictors, such as the restrictors 28, are disposed adjacent to the nip formation member, such as the nip formation pad 24, at an upstream side from the nip formation member in the rotation direction of the fixing belt. With such a configuration, the movement of the lubricant, such as the lubricant 201, dammed by the nip formation member, toward the end of the fixing belt can be regulated. With such a configuration, the lubricant dammed by the nip formation member can be prevented from leaking from the end of the fixing belt.

Aspect 4

In Aspect 3, a lubricant holder, such as the lubricant collector 27, to absorb and hold the lubricant, such as the lubricant 201, adhering to the fixing belt, such as the fixing belt 21, is disposed at an inner side than of the restrictors in the width direction of the fixing belt. With such a configuration, as described in the above-described variation, the lubricant can be held by the lubricant holder and the lubricant impregnated member, such as the slide member 24*a*, and an amount of the lubricant to be held can be increased. With such a configuration, the lubrication effect caused by the lubricant can be maintained over time. In addition, because the lubricant holder is disposed at the inner side from the restrictors, such as the restrictors 28, in the width direction of the fixing belt, the movement of the lubricant leaking from an end of the lubricant holder in the width direction, toward the end of the fixing belt can be regulated by the restrictors.

Aspect 5

In Aspect 4, the lubricant holder, such as the lubricant collector 27, is made of a material having a higher absorbability of the lubricant, such as the lubricant, than an absorbability of the lubricant impregnated member, such as the slide member 24*a*. With such a configuration, the lubricant dammed by the lubricant holder, such as the lubricant collector 27, can be promptly absorbed.

Aspect 6

In any of Aspect 1 to Aspect 5, the restrictor, such as the restrictor 28, has a returning portion, such as the inclined surface 28*b*, to return the lubricant, such as the lubricant 201, adhering to the inner circumferential face of the fixing belt, to an inner side than an end of the lubricant impregnated member, such as the slide member 24*a*, in the width direction of the fixing belt, such as the fixing belt 21. With such a configuration, the lubricant adhering to an outer side of the fixing belt than an end of the lubricant impregnated member, such as the slide member 24*a*, in the width direction of the fixing belt can be returned, using the returning portions of the restrictors, to the inner side than the end of the lubricant impregnated member in the width direction of the fixing belt. With such a configuration, the lubricant adhering to the outer side of the fixing belt than the end of the lubricant impregnated member in the width direction of the fixing belt can be brought into contact with an upstream end of the lubricant impregnated member in the rotation direction of the fixing belt, and can be returned to the lubricant impregnated member. As a result, the lubricant impregnated member can be impregnated with the lubricant, such as the lubricant 201, over time, and the lubrication effect caused by the lubricant can be maintained over time.

Aspect 7

In Aspect 6, the returning portion is an inclined surface inclined toward an upstream side in the rotation direction of the fixing belt, such as the fixing belt 21, from the inner end of the restrictor, such as the restrictor 28, in the width direction of the fixing belt toward an outer side of the restrictor in the width direction of the fixing belt. With such a configuration, if the lubricant, such as the lubricant 201, adhering to the inner circumferential face of the fixing belt contacts the inclined surface of the restrictor, the lubricant moves along the inclined surface, so that the lubricant can be moved to the inner side in the width direction of the fixing belt.

Aspect 8

In Aspect 6 or Aspect 7, an outer end of the returning portion, such as the inclined surface 28*b*, in the width direction of the fixing belt is positioned at an outer side than an end of the lubricant impregnated member, such as the slide member 24*a*, in the width direction of the fixing belt. With such a configuration, the lubricant on the inner circumferential face of the fixing belt that is adhering to the outer side than the end of the lubricant impregnated member, such as the slide member 24*a*, in the width direction of the fixing belt can be returned, using the returning portion, to the inner side than the end of the lubricant impregnated member in the width direction of the fixing belt.

Aspect 9

In any of Aspect 6 to Aspect 8, an inner end of the restrictor in the width direction is positioned on an inner side than an end of the lubricant impregnated member, such as the slide member 24*a*, in the width direction. With such a configuration, the lubricant can be returned, using the returning portion, such as the inclined surface 28*b*, to the inner side than the end of the lubricant impregnated member, such as the slide member 24*a*, in the width direction.

Aspect 10

In any of Aspect 1 to Aspect 9, the restrictors, such as the restrictors 28, are disposed on outer sides than an area in the width direction, in which a recording material having a largest length in the width direction of the fixing belt, among recording materials, such as the sheets P, which can pass through a nip, such as the fixing nip N, passes through the nip. With such a configuration, at least in a recording-material passage area of the lubricant impregnated member, such as the slide member 24*a*, the lubricant adhering to the fixing belt contacts, and is collected by the lubricant impregnated member. With such a configuration, the lubricant can be held at least in a sheet passage area of the lubricant impregnated member. When the sheet is passed, a contact pressure with the fixing belt becomes higher in the sheet passage area of the lubricant impregnated member, and by the lubricant being held in the area, the lubrication effect caused by the lubricant can be effectively obtained.

Aspect 11

In any of Aspect 1 to Aspect 10, the restrictors, such as the restrictors 28, are formed of an elastic member. With such a configuration, the restrictors can be brought into contact with the inner circumferential face of the fixing belt with no space by being elastically deformed, so that the movement of the lubricant 201 adhering to the fixing belt, toward the fixing belt end can be favorably regulated.

Aspect 12

An image forming apparatus includes an image bearer, such as a photoconductor drum 120, a toner image forming unit (including, e.g., a charging device, a developing device, and an optical writing device) that forms a toner image on the image bearer, a transfer unit, such as the transfer device 71, to transfer the toner image from a surface of the image bearer, onto a recording material, such as the sheet P, and a fixing unit, such as the fixing device 20, to fix the toner image transferred on the recording material, onto the recording material. In the image forming apparatus, the fixing device of any of Aspect 1 to Aspect 11 is used as the fixing unit. With such a configuration, the inside of the apparatus can be prevented from getting stained by the lubricant, such as the lubricant 201, leaking from the fixing device.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a rotatable endless fixing belt;

a pressure rotator to contact an outer circumferential face of the fixing belt;

a nip formation pad disposed at an inner circumferential side of the fixing belt, to contact the pressure rotator via the fixing belt to form a nip;

a lubricant impregnated member disposed on the nip formation pad to contact an inner circumferential face of the fixing belt, the lubricant impregnated member impregnated with lubricant; and a plurality of restrictors attached to the nip formation pad to contact the inner circumferential face of the fixing belt, each disposed at an inner side of each end of the fixing belt in a width direction of the fixing belt, to redirect movement of the lubricant adhering to the fixing belt away from each end of the fixing belt in the width direction of the fixing belt, the plurality of restrictors having a lower absorbability of the lubricant than an absorbability of the lubricant impregnated member.

2. The fixing device according to claim 1, wherein the plurality of restrictors is disposed adjacent to the nip formation pad at an upstream side from the nip formation pad in a rotation direction of the fixing belt.

3. The fixing device according to claim 2, further comprising:

a lubricant holder disposed at an inner side of the plurality of restrictors in the width direction of the fixing belt.

4. The fixing device according to claim 3, wherein the lubricant holder is made of a material having a higher absorbability of the lubricant than an absorbability of the lubricant impregnated member.

5. The fixing device according to claim 1, wherein each of the plurality of restrictors has a returning portion to return the lubricant adhering to the inner circumferential face of the fixing belt to an inner side of each end of the lubricant impregnated member in the width direction of the fixing belt.

6. The fixing device according to claim 5, wherein the returning portion is an inclined surface inclined toward an upstream side in a rotation direction of the fixing belt from an inner end of each of the plurality of restrictors in the width direction of the fixing belt toward an outer side of each of the plurality of restrictors in the width direction of the fixing belt.

7. The fixing device according to claim 5, wherein an outer end of the returning member in the width direction of the fixing belt is positioned at an outer side of an end of the lubricant impregnated member in the width direction of the fixing belt.

8. The fixing device according to claim 5, wherein an inner end of each of the plurality of restrictors in the width direction of the fixing belt is positioned at an inner side of an end of the lubricant impregnated member in the width direction of the fixing belt.

9. The fixing device according to claim 1, wherein each of the plurality of restrictors is disposed at an outer side in the width direction of the fixing belt at an area in which a recording material having a largest length in the width direction of the fixing belt passes through the nip, among recording materials to pass through the nip.

10. The fixing device according to claim 1, wherein each of the plurality of restrictors is an elastic member.

11. The fixing device according to claim 1, further comprising:

a plurality of guide members to contact the inner circumferential face of the fixing belt at both ends of the fixing belt in the width direction of the fixing belt, to guide rotation of the fixing belt, wherein the plurality of restrictors is disposed at an inner side of the plurality of guide members in the width direction of the fixing belt, to redirect movement of the lubricant adhering to the inner circumferential face of the fixing belt away from an outer side in the width direction of the fixing belt.

12. An image forming apparatus comprising:

an image bearer;

a toner image forming unit to form a toner image on the image bearer;

a transfer unit to transfer the toner image from a surface of the image bearer onto a recording material; and the fixing device according to claim 1 to fix the toner image transferred on the recording material, onto the recording material.

* * * * *